US005289804A

United States Patent [19]

Mori

[11] Patent Number: 5,289,804

[45] Date of Patent: Mar. 1, 1994

[54] TAPPET IN AN INTERNAL COMBUSTION ENGINE

[75] Inventor: Akiyoshi Mori, Fujisawa, Japan

[73] Assignee: Fuji Oozx Inc., Japan

[21] Appl. No.: 36,916

[22] Filed: Mar. 25, 1993

[51] Int. Cl.[5] ..... F01L 1/14; F01L 3/04

[52] U.S. Cl. ..... 123/90.51; 123/90.48; 74/569

[58] Field of Search ..... 123/90.48, 90.51; 74/569

[56] References Cited

U.S. PATENT DOCUMENTS

| | | | |
|---|---|---|---|
| 2,932,290 | 4/1960 | Christensen | 123/90.51 |
| 4,873,150 | 10/1989 | Doi et al. | 123/90.51 |
| 4,876,996 | 10/1989 | Mayer et al. | 123/90.51 |
| 4,909,198 | 3/1990 | Shiraya et al. . | |

FOREIGN PATENT DOCUMENTS

| | | |
|---|---|---|
| 1-315607 | 12/1989 | Japan . |
| 2-33406 | 2/1990 | Japan . |
| 2-40009 | 2/1990 | Japan . |

OTHER PUBLICATIONS

Japanese Utility Model No. 62-138803, published Sep. 1, 1987.

Japanese Utility Model No. 63-174508, published Nov. 11, 1988.

*Primary Examiner*—E. Rollins Cross
*Assistant Examiner*—Weilun Lo
*Attorney, Agent, or Firm*—Poms, Smith, Lande & Rose

[57] ABSTRACT

A tappet for use in an internal combustion engine comprises Al-alloy base material and a sprayed layer on the outer surface which is slidable with a cylinder head. The sprayed layer is made of Fe-alloy which comprises not more than 0.1% by weight of C, 0.6-2.0% by weight of Mn and the balance of Fe, thereby providing high hardness, high toughness and low cost. The sprayed layer may further contain 0.1-1.0% by weight of Si.

4 Claims, 4 Drawing Sheets

EFFECTS OF C AND Mn TO TENSILE STRENGTH

TEST OF TEMPERATURE EFFECTS TO IMPACT STRENGTH

TAPPET IN AN INTERNAL COMBUSTION ENGINE

BACKGROUND OF THE INVENTION

The present invention relates to a tappet or a valve lifter for use in a reciprocating internal combustion engine.

In a known tappet for an internal combustion engine, for example, carburizing hardening has been applied to a tappet body made of steel or cast iron. Recently, coated light alloys have been used in Japanese Utility Model Laid-Open Pub. No. 63-174508; NiP alloy plated metal in Japanese Utility Model Laid-Open Pub. No. 62-138803; and Fe-C sprayed metal in Japanese Patent Laid-Open Pub. No. 1-315607.

However, in the known steel or cast-iron tappets or light alloy tappets which are subject to surface treatment, there are disadvantages such as increase in mass in steel or cast iron tappets; increase in cost in tappets as disclosed in Japanese Utility Model Laid-Open Pub. Nos. 63-174508 and 62-138803; and decrease in toughness of a sprayed layer as disclosed in Japanese Patent Laid-Open Pub. No. 1-315607, which could not be solved sufficiently.

In view of the disadvantages, the object of the present invention is to provide a light-alloy tappet in an internal combustion engine having low cost, a wear-resistant sprayed layer and high toughness.

SUMMARY OF THE INVENTION

To attain the object, according to the present invention, there is provided a tappet for use in a reciprocating internal combustion engine, the tappet comprising light-alloy base material made of Al-alloy; and a sprayed layer made of Fe-alloy which comprises not more than 0.1% by weight of C. 0.6–2.0% by weight of Mn and the balance of Fe. Preferably, the Mn contents in the sprayed layer may be 1.0–1.4% by weight. Preferably, the C contents in the sprayed layer may be 0.07–0.08% by weight.

The present invention is concerned with a tappet as disclosed in Japanese Patent Laid-Open Pub. No. 1-315607, and the function of the present invention will be described compared therewith. Claims in the publication describes Fe-C sprayed layer which contains more than 0.1% by weight of C and having hardness of more than Hv300. The percentage of each element will hereinafter refer to "by weight". But, the sprayed layer which consists of Fe and C seldom attains toughness of more than Hv300 by containing about 0.1% of C. Actually, to attain toughness of more than Hv300, it will be necessary to contain at least 0.2% of C. Increase in C contents could increase toughness, but cracking is liable to occur.

A tappet for an internal combusition engine is generally subject to high temperature up to 140° C. and large load for a long time. Meanwhile, the more carbon contents are, the more susceptibility to cracking in material is, as described in "Yosetsu Binran(The Welding Handbook)", page 889, issued by Maruzen K. K. on Mar. 31, 1977. Further, when a sprayed layer is formed on the surface of Aluminum base material, a tappet is subject to temperature of about 140° C., so that both the base material and outer circumference swells by heating. The aluminium base material swells larger than the outer sprayed layer, so that the sprayed layer is subject to large tensile force in a circumferential direction.

Accordingly, the sprayed layer which comprises aluminium alloy base material needs high hardness having high wear resistance; high tensile strength for bearing the foregoing tensile force; and high toughness for bearing large load. The invention in said publications tried to attain those by adding only carbon, but an alloy which consists of Fe and C could not increase both strength and toughness. So, it has been considered that another element was substituted partially for C. Fe alloys could decrease carbon contents by another element, keeping hardness and strength. Table 1 shows change in yield point per 0.1% increase of alloy elements as described in "Yosetsu Binran (The Welding Handbook)", page 884, issued by Maruzen K. K. on Mar. 31, 1977.

TABLE 1

| | Element | | | | | | | |
|---|---|---|---|---|---|---|---|---|
| | C | Mn | Si | V | Cr | Mo | Ti | Nb |
| Increasing rate of yield point ($kg/mm^2$) | 4.7 | 1.8 | 0.2 | 7.3 | 0 | 4.1 | 0 | 12 |
| Ratio | 1 | 1/3 | 1/20 | 1.4 | 0 | 1 | 0 | 3 |

Therefore, Nb is most suitable as carbon-substituting element, while V and Mo are more suitable. However, Nb is very expensive, so that its addition involves increase in cost. V and Mo decreases toughness. Therefore, it is suitable to add Mn. If the addition of Mn is three times as heavy as C-decreasing amount, the same strength will be obtained.

Toughness is also meant by susceptibility to cracking. Pw, the index of susceptibility to cracking in welding material, is given by the following formula:

$$Pw(\%)=Pcm+1/60[H]+1/40000K$$

$$Pcm(\%)=C+1/30Si+1/20Mn+1/20Cu+1/60Ni+1/20Cr+1/15Mo+1/10V+5B$$

This shows that the effect to susceptibility to cracking of Mn is 1/20 of that of C. The effects of Mo and V are considerably larger than that of Mn. In order to increase toughness while maintaining strength, it is found that suitable Mn amount may be preferably added with decrease carbon amount. The amount may be preferably three times as heavy as carbon decrease amount. The toughness is decreased only by 3/20 as to effects of carbon decrease amount. Accordingly, both strength and toughness can be maintained by decrease of C and addition of Mn.

The same hardness as what contains more than 0.2% of C is attained by containing not more than 0.1% of C and 0.6–2.0% of Mn in the sprayed layer of the present invention. Also, the disadvantages on toughness can be decreased to 3/20 of what contains more than 0.2% of C. Further no expensive material is contained, which is advantageous in cost.

In the sprayed layer, Si may be added. When Si is added, a concentrated sprayed layer having increased flowablity of molten metal can be easily formed and the foregoing disadvantages could be further overcome. The contents of Si may be 0.5–1.0% by weight in view of the Table 1, formula and flowabilty of molten metal. If Si contents exceed 1.0% by weight, the sprayed layer will become fragile. As mentioned above, the present invention is distinctive over the art as disclosed in Japanese Patent Laid-Open Pub. No. 1-315607.

BRIEF DESCRIPTION OF THE DRAWINGS

The above and other features and advantages of the present invention will become more clear based on the following description with respect to drawings wherein.

DESCRIPTION OF THE PREFERRED EMBODIMENTS

Figure 1:
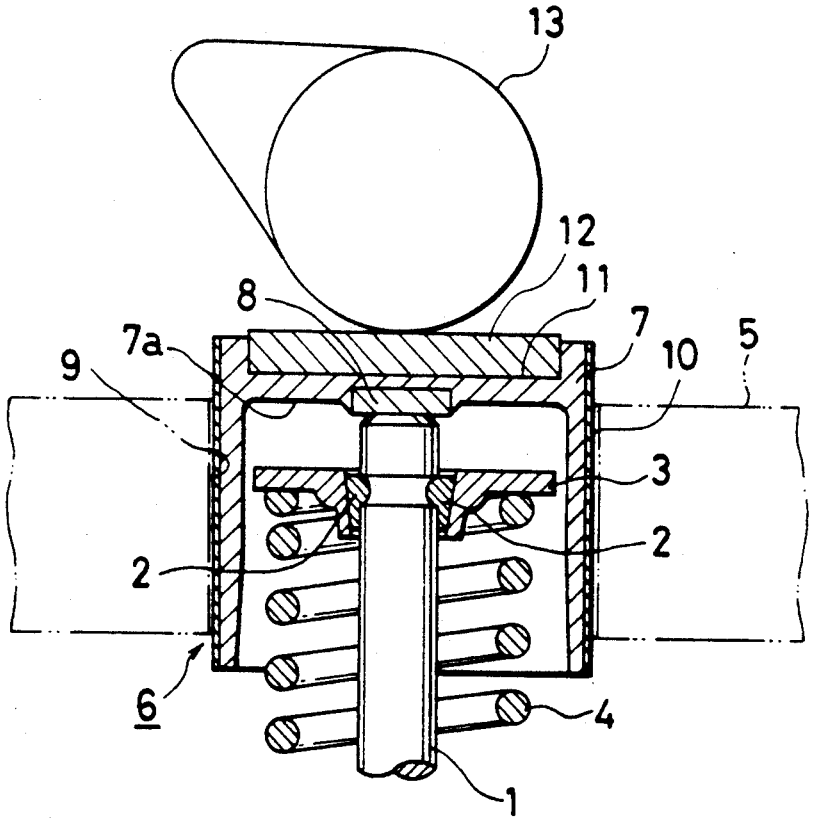
FIG. 1 is a longitudinal sectioned front view of a direct-acting valve operating mechanism which comprises a tappet according to the present invention.

FIG. 1 illustrates an embodiment of a tappet in a direct-acting valve operating mechanism for use in a DOHC type engine according to the present invention, in which 1 denotes an engine valve; 2 denotes a pair of cotters which are fitted in an annular groove on the axial end of the engine valve 1; 3 denotes a spring retainer around the cotters 2; and 4 denotes a valve spring between the lower portion (not shown) of the cylinder head 5 and the spring retainer 3. There is provided a tappet 6 according to the present invention at the upper portion of the engine valve 1. The tappet 6 comprises a cylindrical tappet body 7 the upper end of which is closed. On the lower surface of the top wall 7*a*, there is provided a tip 8 which contacts the axial end of the engine valve 1, so that the upper end of the engine valve 1 is covered with the tappet 6. The tappet body 7 is made of Al-Si alloy which has Al matrix, for example, as disclosed in Japanese Patent Laid-Open Pub. No. 1-315607.

On the outer surface of the tappet body 7 which is slidable in a guide bore 9 provided in the cylinder head 5, there is formed a sprayed layer 10 having thickness such as 0.1 to 0.3 mm and made of Fe alloy which comprises not more than 0.1% by weight of C; 0.6–2.0% by weight of Mn and the balance of Fe. In the sprayed layer 10, 0.5–1.0% of Si may be preferably contained. The addition of Si decrease the surface tension of the molten metal, and increases flowability, thereby easily forming the concentrated sprayed layer 10.

A valve clearance adjusting shim 12 made of wear resistant metal is detachably fitted in a circular recess 11 on the upper surface of the top wall 7*a* of the tappet body 7. By contacting a rotary cam 13 on the upper surface of the shim 12, the tappet body 7 is pressed downwardly, and the engine valve 1 is, therefore, pressed downwardly via the tappet body 7 and the tip 8. The tappet 6 may be made as disclosed in Japanese Patent Laid-Open Pub. No. 1-315607. The tappet body 7 is moulded by cold forging out of Al-Si Aluminium alloy (Si:11.6%, Cu:4.1%, Mg:0.8%; and the balance of Al and inevitable impurities); mechanically fabricated to a certain size; and is subject to heat treatment. Then, the carbon-steel wear resistant tip 8 is pressed onto the lower surface of the top wall of the tappet body 7, so that the circumference of the lower surface is caulked. On the outer circumference of the tappet body 7, Fe sprayed layer having thickness of 100–200 m is formed by spraying. After the sprayed layer 10 is subject to abrasive finishing, the shim 12 separately formed is fitted in the recess 11 of the tappet body 7.

EXAMPLE

Samples in which the sprayed layer 10 comprise the following different ingredients are prepared, and hardness and wear rate are determined for each sample, so that the following results are attained.

TABLE 2

| | C | Mn | Balance |
|---|---|---|---|
| Sample 1 (S1) | 0.1 | 0 | Fe and inevitable impurities |
| Sample 2 (S2) | 0.2 | 0 | Fe and inevitable impurities |
| Sample 3 (S3) | 0.6 | 0 | Fe and inevitable impurities |
| Sample 4 (S4) | 0.8 | 0 | Fe and inevitable impurities |
| Sample 5 (S5) | 0.08 | 0.4 | Fe and inevitable impurities |
| Sample 6 (S6) | 0.08 | 0.6 | Fe and inevitable impurities |
| Sample 7 (S7) | 0.08 | 0.8 | Fe and inevitable impurities |
| Sample 8 (S8) | 0.08 | 1.1 | Fe and inevitable impurities |
| Sample 9 (S9) | 0.08 | 1.35 | Fe and inevitable impurities |

Figure 2:
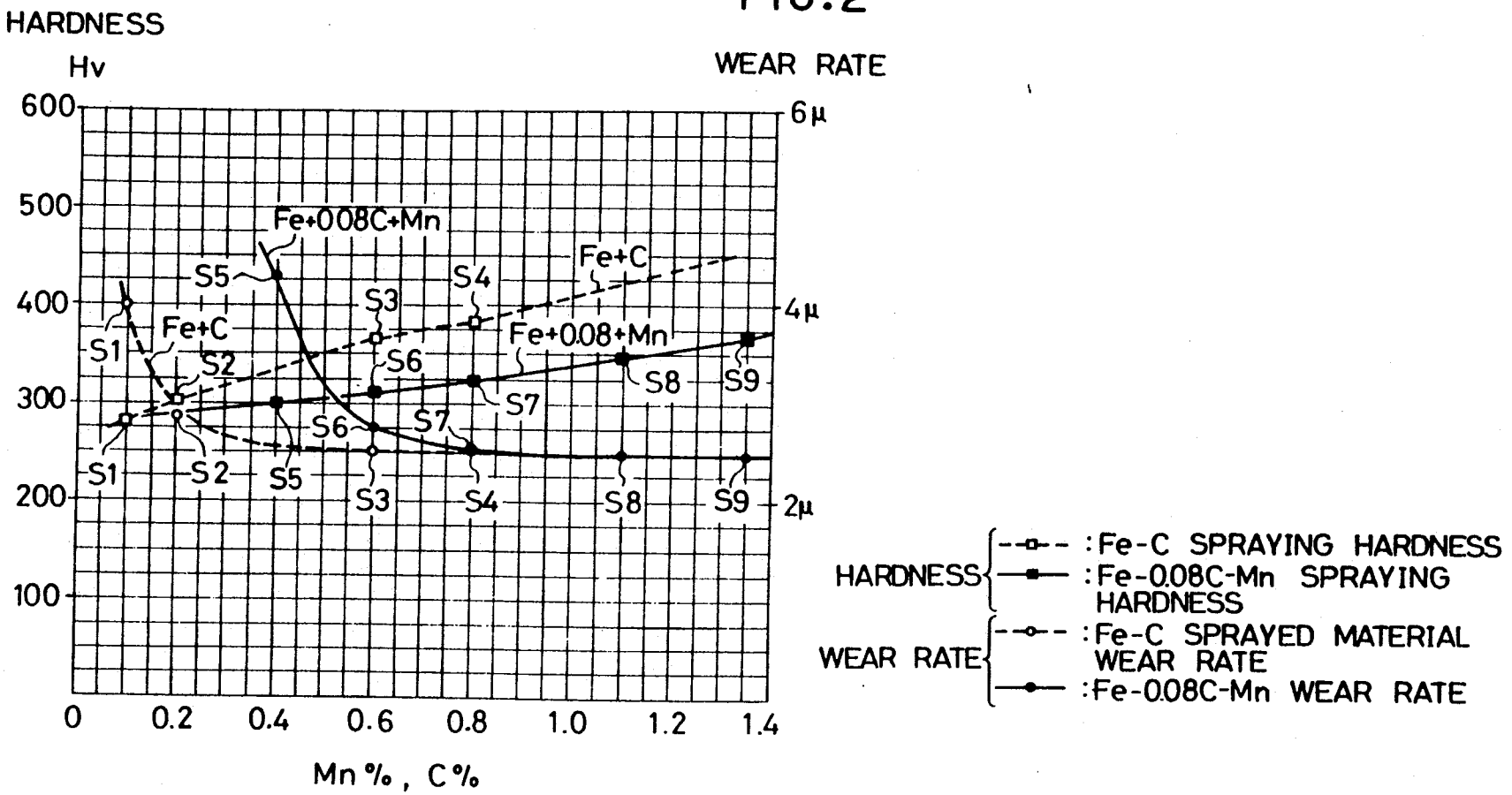
FIG. 2 is a graph which illustrates the relation of hardness and wear rate to C and Mn contents in experimental results of the present invention.

FIG. 2 illustrates the relation of hardness and wear rate to C and Mn contents. The wear rate in FIG. 2 relates to those after an engine having each sample is worked at rotation speed of 6400 rpm for 2400 hours. In FIG. 2, as to hardness, 0.3% increase of Mn is substantially equal to 0.1% increase of C. When Mn is over 0.6%, hardness is more than Hv300, and increase in hardness decreases wear rate. When Mn is over 0.6%, wear rate becomes a fixed value. When C is more than 0.3%, the alloy becomes stable at similar value.

Figure 3:
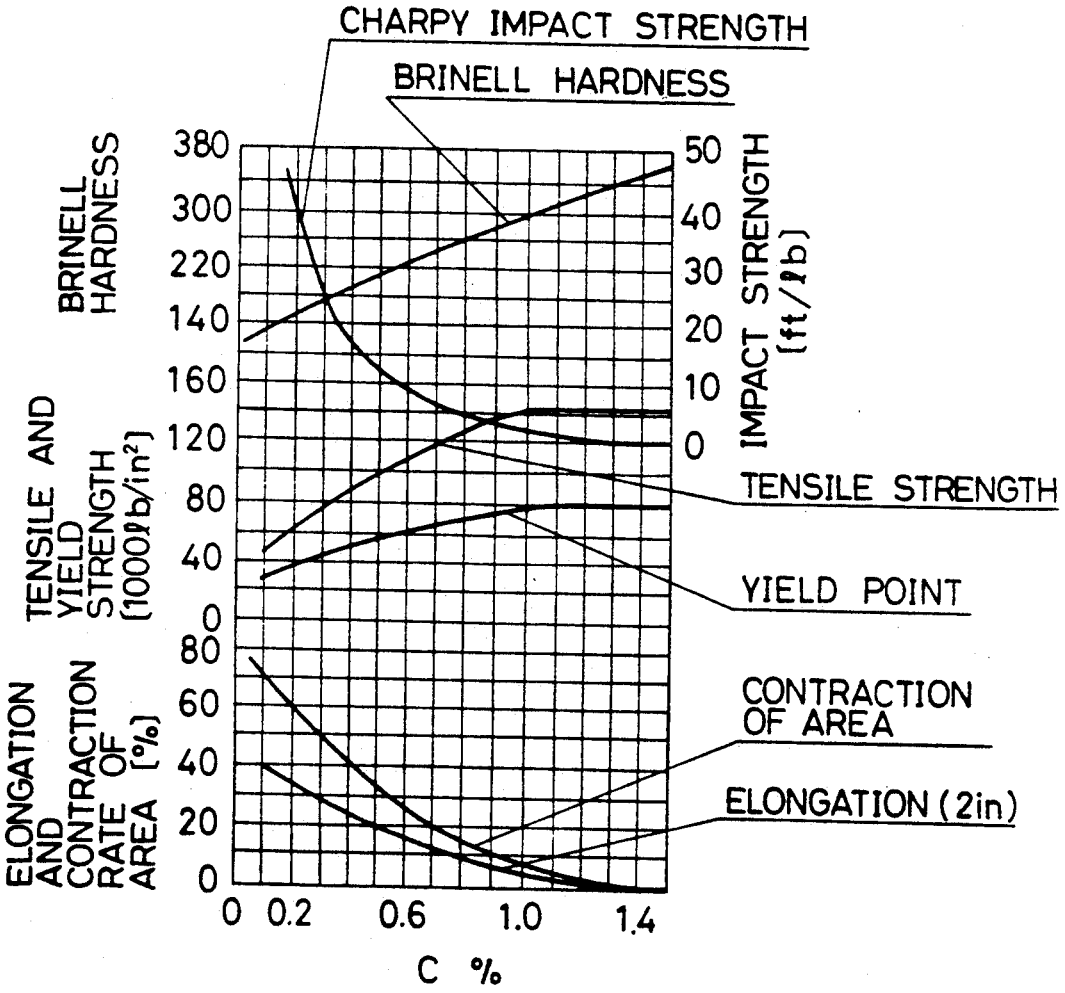
FIG. 3 is a graph which illustrates the relation of Charpy strength to carbon contents.
Figure 4:
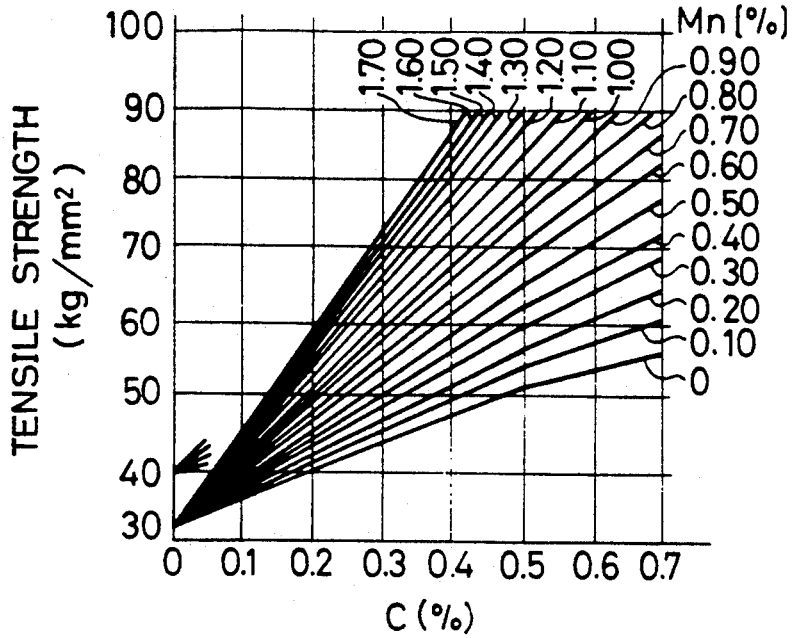
FIG. 4 is a graph which illustrates the relation of tensile strength to C and Mn contents.
Figure 5:
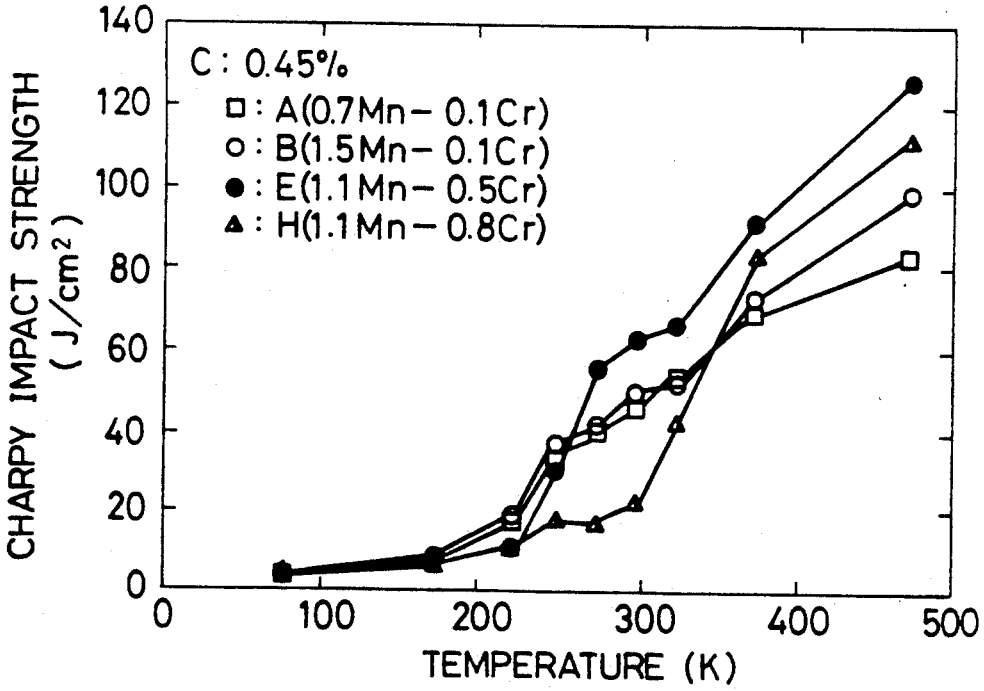
FIG. 5 is a graph which illustrates the relation of Charpy strength to Mn contents and temperature.

As to each of the samples, there are no experimental data on toughness, but in view of the known data in FIGS. 3, 4 and 5, it will be easily understood that toughness is increased compared with what contains more than 0.2% of C, by containing not more than 0.1% of C and 0.6–2.0% of Mn in the sprayed layer. FIGS. 3 and 4 are the same as those in "TEKKO BINRAN (THE STEEL HANDBOOK)", page 87, edited by Nihon Tekko Kyokai and issued by Maruzen K. K. on Apr. 5, 1962. FIG. 3 illustrates that Charpy strength decreases with increase of C contents, and FIG. 4 illustrates that equal strength (tensile strength) is obtained by substituting Mn for C. FIG. 5 is the same in what is described in "DENKI SEIKO (ELECTRIC STEEL MANUFACTURING)", vol. 63(1992), No. 1, page 19 issued by Takeda Insatsu K. K. on Jan. 15, 1992 and edited by Denki Seiko Kenkyukai, and illustrates that Charpy strength increases with increase of Mn contents if C contents is the same.

The advantages of the tappet according to the present invention are as follows:

a) Hardness similar to what is obtained by containing more than 0.2% of C can be attained by containing not more than 0.1% of C and 0.6–2.0% of Mn in the Fe-alloy sprayed layer.

b) The disadvantages on toughness are decreased to about 3/20 of what is obtained by more than 0.2% of C by containing not more than 0.1% of C and 0.6–2.0% of Mn.

c) No expensive elements are contained and it is advantageous in cost.

d) The advantages (a) to (c) provides a tappet for use in an internal combustion engine having low cost, high hardness and high toughness.

The foregoing merely relates to preferable embodiments of the present invention. Various modifications and changes may be carried out by person skilled in the art without departing from the scope of claims wherein:

What is claimed is:

1. A tappet for use in an internal combustion engine, comprising light alloy base material made of Al-alloy; and a sprayed layer on an outer surface slidable with a cylinder head, the sprayed layer being made of Fe-alloy which comprises not more than 0.1% by weight of C; 0.6–2.0% by weight of Mn; and the balance of Fe.

2. A tappet as defined in claim 1 wherein the sprayed layer further contains 0.5–1.0% by weight of Si.

3. A tappet as defined in claim 1 wherein the Mn contents in the sprayed layer are 1.0–1.4% by weight.

4. A tappet as defined in claim 1 wherein the C contents in the sprayed layer are 0.07–0.08% by weight.

* * * * *